United States Patent [19]

Vedenpää

[11] Patent Number: 4,481,723

[45] Date of Patent: Nov. 13, 1984

[54] PAPER MACHINE MULTIPLE CYLINDER DRYER

[75] Inventor: Timo Vedenpää, Jyväskylä, Finland

[73] Assignee: Valmet Oy, Finland

[21] Appl. No.: 324,862

[22] Filed: Nov. 24, 1981

[30] Foreign Application Priority Data

Dec. 1, 1980 [FI] Finland ..... 803720

[51] Int. Cl.[3] ..... F26B 13/08

[52] U.S. Cl. ..... 34/114; 34/116; 34/117; 34/123

[58] Field of Search ..... 34/114, 115, 116, 117, 34/120, 123

[56] References Cited

U.S. PATENT DOCUMENTS

| | | | |
|---|---|---|---|
| 1,595,478 | 8/1926 | Minton | 34/117 |
| 2,910,784 | 11/1959 | Metcalfe | 34/114 |
| 3,049,809 | 8/1962 | Sellers | 34/114 |
| 3,250,019 | 5/1966 | Beachler | 34/117 |
| 3,283,415 | 11/1966 | Schnyder | 34/111 |
| 3,355,816 | 12/1967 | McKie et al. | 34/116 |
| 3,751,822 | 8/1973 | Crist | 34/123 |
| 4,172,007 | 10/1979 | Kankaanpää34 | 117/ |
| 4,359,828 | 11/1982 | Thomas | 34/114 |
| 4,416,070 | 11/1983 | Vedenpa et al. | 34/114 |

*Primary Examiner*—Larry I. Schwartz
*Assistant Examiner*—David W. Westphal
*Attorney, Agent, or Firm*—Steinberg & Raskin

[57] ABSTRACT

A paper machine multiple cylinder dryer includes a plurality of drying cylinders, in conjunction with which a drying fabric supports the web as it moves from one cylinder to another in closed conduction. A supporting fabric supports the web on some of the cylinders. The runs of the web supported by the drying fabric, the free surfaces of the drying cylinders and the runs of the supporting fabric confine elongated pockets in conjunction with the cylinders. In order to prevent web breaks occurring in the drying section of the fast-running paper machine, since such breaks are among the most important factors limiting the increasing of paper machine speeds, the multiple cylinder dryer provides a pressure greater than the ambient atmosphere pressure in the pockets in the direction of travel of the web, at least in the initial part of the dryer. This results in the considerable stabilization of the running of the web. One manner of producing the over-pressure is to partially or totally close both ends of the pockets with particular closing plates.

17 Claims, 6 Drawing Figures

PAPER MACHINE MULTIPLE CYLINDER DRYER

BACKGROUND OF THE INVENTION

The present invention relates to a paper machine multiple cylinder dryer.

The paper machine multiple cylinder dryer includes a plurality of heatable drying cylinders and corresponding rollers. A drying fabric supports the web, passing from one cylinder or roller to another in closed conduction. The cyclic path of the drying fabric is such that part of the drying cylinders or rollers remain within the loop of the fabric and part remain outside the fabric. A supporting fabric carries the web on the cylinders and rollers. The supporting fabric is guided by guide rollers. Elongated pockets present in the dryer are defined, in conjunction with the cylinders, by the web runs supported by the drying fabric, the free surfaces of the drying cylinders and the run of the supporting fabric.

Web breaks in the drying section of fast-running paper machines constitute an essential factor limiting the operation of such machines at higher speeds.

The term "closed conduction" is understood herein to mean a so-called single felt conduction, wherein one or a plurality of rollers or cylinders of a drying cylinder group are located within a felt loop implementing the single felt conduction and the other cylinder is, or the other cylinders are, outside the loop. Although fabrics are called "felts" herein, the word "felts" is understood to mean any type of usable fabrics such as, for example, reticular plastic fabrics.

Single felt conduction is in itself a technique known in the art. For example, U.S. Pat. No. 796,601 discloses a felt run pattern for single felt conduction. However, to the inventors' knowledge, single felt conduction was not introduced in commercial use until about 70 years after it was invented. The applications of single felt conduction have primarily been fast-running machines. In such cases, however, pressure is generated in the closing-down nips on those drying cylinders where the web lies outermost. This pressure tends to detach the web from the fabric and, in fact, partly does so. The air trapped between the fabric and the web on those drying cylinders where the web lies between the cylinder and the felt is thereby compelled to escape, in the closing-down nip, from between the web and the fabric. This tends to produce a so-called blowing effect on the web. Of the aforementioned phenomena, the former requires a felt as impermeable as possible and the latter requires one with highest possible permeability. For this reason, despite endeavors to provide optimum felt permeability, the aforedescribed phenomena promote the occurrence of breaks and impose a limit on the speed increase. Furthermore, optimum felt permeability does not yield the best possible evaporation. In addition, the web must carry and maintain, when outermost on the cylinder arc, stresses arising from centrifugal forces. When the velocity increases past 1000 m/min, these stresses come close to the original wet strength of the web in fast-running paper machines, with typical pulps.

Finnish patent application No. 780333 of J. M. Voith GmbH discloses the installation of a flow obstacle in the nip in question, in an effort to eliminate the blowing effect in a nip where the web lies outermost. However, this procedure of the known art fails to eliminate the blowing effect exerted on the web by a closing-down nip where the felt is outermost. Furthermore, this procedure does not possibly provide support for the web when the web is outermost on the cylinder arc.

Conduction of the web between two fabrics throughout the time of cylinder drying or blow-on drying, is also known in the prior art, as disclosed in U.S. Pat. Nos. 1,122,282; 3,378,936 and 3,576,078.

Both of the aforementioned known arrangements cause a substantial reduction in the drying effect. This is a serious drawback, since drying is, of course, the primary task and object of the drying section.

It has also been suggested that differential pressure be utilized to support the web in connection with single felt conduction, while it lies outermost on a cylinder. Thus, for example, Finnish patent application No. 771056 (corresponding to U.S. Pat. No. 4,202,113) and No. 793643 disclose the application of differential pressure to those cylinders where the web is outermost, through the recessed surfaces of the respective cylinders. If required, sub-atmospheric pressure is then also applied to the periphery of the cylinder. The supporting effect of the application of sub-atmospheric pressure also extends to the smooth cylinder and to the free draw between cylinders. However, the solutions hereinbefore described imply special vacuum arrangements, and their drawbacks include sealing problems and extra power consumption.

U.S. Pat. No. 4,000,035 discloses drying and forwarding the web in conjunction therewith in outermost position on the cylinder with the aid of through-flow drying. This type of drying produces pressure urging the web toward the felt. This particular arrangement also features a pull-in strip movable in the cross-web direction on the cylinders by special dispositions. A drawback of the arrangement of U.S. Pat. No. 4,000,035 is that the end product produced by the paper machine, excluding so-called tissue brands, has a permeability so low that the effect of through-flow drying is poor. Furthermore, evaporation achieved in this manner is exceedingly costly.

Finnish patent application No. 761953 (corresponding to U.S. Pat. No. 4,183,148) and Finnish patent No. 54,954 (corresponding to U.S. Pat. No. 4,172,007) disclose the use of a supporting fabric in connection with single felt conduction in order to try to prevent web detachment from those cylinders on which the web lies outermost. Furthermore, said Finnish patent discloses a blowing effect to urge the web against the cylinder, in those sectors where the web lies outermost and where the fabric does not support the web. However, the procedure disclosed by said Finnish patent cannot prevent the web from separating from the felt on the free draws. Furthermore, it is impossible to prevent the web from following along with the cylinder in those opening-up clefts where the cylinder abuts the web.

It is also previously known from drying groups with normal web conduction that the pressure and flow conditions in the pocket may be influenced, in the first place, by the running speed, felt permeability and location of the felt guide roller, as disclosed in Finnish patents No. 44332 and 45884 of the present inventors. However, the object of said Finnish patents is to maintain the pressure in the pocket as high as the atmospheric pressure prevailing on the ends of the cylinders. Furthermore, the inventions of said Finnish patents are intended for use in connection with standard conduction.

SUMMARY OF THE INVENTION

The principal object of the invention is to provide a paper machine multiple cylinder dryer which considerably reduces or prevents web breaks and their attendant detriments.

In order to avoid the drawbacks of the multiple cylinder dryers of the prior art and to realize the objects of the invention, a pressure greater than the ambient atmospheric pressure is applied to the pockets of a multiple cylinder dryer, at least in the initial part of the dryer as seen in the direction of travel of the web. This results in the principal advantage of stabilizing the running of the web.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
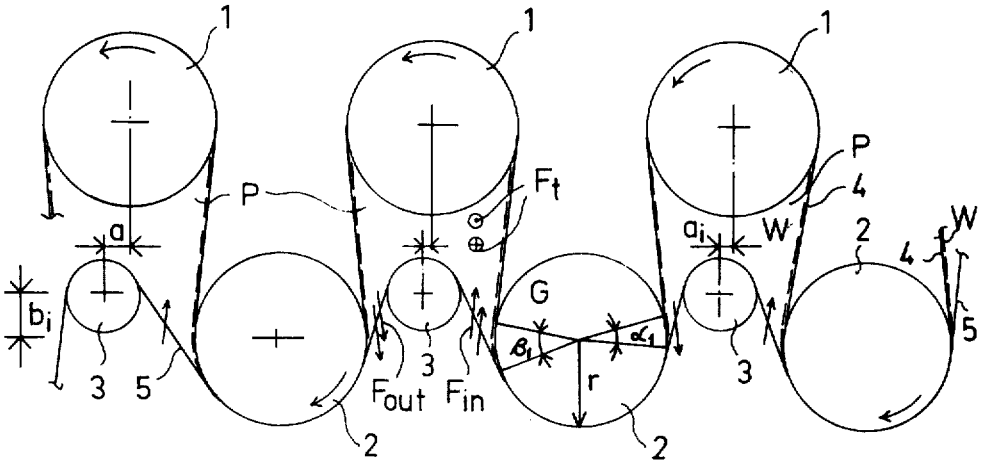
FIG. 1 is a schematic elevational view of an embodiment of the multiple cylinder dryer of the invention.

The invention relates, for example, to multiple cylinder dryers consisting, as shown in FIG. 1, of two rows of cylinders having cylinders 1 and 2 intercalated and suitably vertically spaced from each other. The invention is also applied or relates to a multiple cylinder dryer of the type in which a web W runs, carried by a drying fabric 4 such as, for example, felt, in zigzag fashion from the upper cylinders 1 to the lower cylinders 2, and vice versa. Furthermore, as shown in FIG. 1, the web on the lower cylinders 2 is carried by a supporting fabric 5, the run of which is governed by guide rollers 3 located in the intervals of said lower cylinders.

The joint runs of the drying fabric 4 and the web W between the cylinders 1 and 2, and 2 and 1, respectively, together with the free surface of the upper cylinders 1, and with the runs of the supporting fabrics guided by the guiding rollers 3, define pockets P in the interstices of the cylinders. The vertical sides of the pockets P border on the runs of the web W supported by the drying fabric 4 between the cylinders 1 and 2, and 2 and 1.

As shown in FIG. 1, the sub-atmospheric pressure produced in the pocket P is actively acted upon by the placement of the felt guide roller 3. Other parameters of influence are the permeability of the felt 4 to air and the capacity of the felt to carry air along with it, the speed at which the web W is run, and the openness of the pocket P and of its end.

It is assumed in the following explanation that the rollers 3 have been shifted from the symmetric position towards the dry end, as FIG. 1 shows. The air flow $F_{in}$, induced and entrained with itself by the fabric 5 between the drying cylinder 2 and the roller 3, flows through said fabric into the pocket P. Since the permeability of the web W is very low compared with the fabric 4, the air that has been pumped in, as described, must flow either through between the roller 3 and the cylinder 2 or through the ends of the pocket P, which are at least partly open. Since the distance between the roller 3 and the adjacent cylinder 2 towards the dry end is less than the corresponding distance between that roller 3 and the other adjacent cylinder towards the wet end, and since the air currents induced by the fabric 5 may be considered approximately equal, the air quantity $F_{out}$ flowing away from the pocket P in this manner is evidently smaller than the inflow quantity $F_{in}$. As a consequence, in the equilibrium state, a minor over-pressure is created in the pocket P, which tends to discharge in the form of transversal flows $F_t$ directed outward from the ends of said pocket. The constricting of the flows $F_t$, that is, the regulating of the openness of the end of the pocket P, permits the pressure produced in said pocket and the flow situation to be regulated.

The aforedescribed flow, that is, the pumping effect of the fabric 4, increases almost linearly with the velocity of the web W. Increase of the permeability of the fabric 4 likewise increases the aforementioned pumping effect, and the influence is not linear in this phenomenon. The type of fabric also has an essential significance regarding the pumping effect. More particularly, a fabric having a rough surface pumps more air than one having a smooth surface.

It is thus understood that by suitably combining the aforementioned factors, it is possible to produce a given over-pressure in the pocket P. This over-pressure urges the web W against the fabric 4 over their entire free draw from the cylinders 1 to the cylinders 2, in the areas of the sides of the pockets P. In this connection, a cylinder is understood to be a machine element having a circular cross-section, not only a steam-heated drying or heating cylinder. The over-pressure urges the web W against the fabric 4 also in sectors $\alpha_1$ and $\beta_1$ where the underside supporting fabric 5 is not lying against the web W.

The course of the web W during one period, upper cylinder to lower cylinder, is as follows. The web W arrives, carried by the drying fabric 4, in the cleft opening from the upper cylinder 1, where it is forced, in connection with the initial threading operation, to become separated from said upper cylinder and to follow along with said drying fabric. At this juncture, the over-pressure prevailing in the pocket P urges the web W tightly against the drying fabric 4, whereby, among other things, the formation of wrinkles is avoided in the nip closing up between said drying fabric and the supporting fabric 5 which is encountered at the lower cylinder 2. The forces tending to detach the web W from the drying fabric 4 on the free draw of said drying fabric and said web are rather minor, if they materialize at all, with the consequence that even a minimal over-pressure in the pocket P is enough to overcome them. The supporting fabric 5 is not yet in contact with the web W in the arc $\alpha_1$ of the cylinder 2. However, a pressure due to centrifugal force is active in this sector. This pressure is defined by equation $$p = m_{tot}(v^2/r) \quad (1)$$

wherein p=pressure, $m_{tot}$=web mass, v=web velocity and r=cylinder radius.

Substituting in Equation (1) the values $m_{tot}$=0.125 kg, v=1000 m/min=16.7 m/s and r=0.915, which are typical for a fast paper machine, p=38 Pa, which is the equivalent of about 3.8 mm water column, is obtained.

On the other hand, the aforementioned arc $\alpha_1$ is short, so that the time during which the web W stays in said arc is also very short, 0.01 to 0.02 seconds. Thus, it may be found by the formula of uniformly accelerated motion $$s = \tfrac{1}{2}at^2 \quad (2)$$

$$a = (v^2/r) \quad (3)$$

that the web W has time to separate from the drying fabric 4 at most about 0.01 to 0.05 mm. This detachment is counteracted by the over-pressure produced in the aforedescribed manner in the pocket P. If this over-pressure at least equals, for example, the hereinbefore calculated 38 Pa, no such detachment of the web W occurs at all. It is true, of course, that the cylinder 2 and the drying fabric 4 induce along with themselves the aforedescribed flows $F_{in}$ and $F_{out}$, but since said cylinder is inherently smooth and endeavors are made to select a smooth drying fabric, the pressure arising in the cleft between said drying fabric and said cylinder from the flows $F_{in}$ and $F_{out}$ is less significant than the over-pressure actively and deliberately produced in the pocket P in accordance with the invention.

The web W is sandwiched between the drying fabric 4 and the supporting fabric 5 on the lower cylinder 2. The web W, between the fabrics 4 and 5, is urged tightly against the fabric 4, due to the tensioning of the fabric 5. The fabrics 4 and 5 are preferably smooth on their sides facing the web W and are, for example, covered with pile-resembling fibers. Thus, by maintaining a suitably low tension on the supporting fabric 5, the risks of marking the surface of the web W are avoided. Since the fabrics 4 and 5 are contiguous only in arcs having an equal radius, their angular velocity is automatically controlled to be constant in these arcs, thereby eliminating the risk factor of attrition between said fabrics with comparative ease. In addition, the effect of minor differences in diameter due to the tolerance of the different cylinders and temperature differentials, which may be greatly reduced by modern manufacturing techniques, are minimizable by selecting supporting fabric 5 which presents good elasticity in its longitudinal direction.

When the point of the web W under consideration arrives in the arc $\beta_1$ on the lower cylinder 2, it is once again subject to the effect of centrifugal force and devoid of support from the external supporting fabric 5. The foregoing description regarding centrifugal force, pressure and time spent in the arc $\alpha_1$ also applies to the arc $\beta_1$. That is, the web W has under no circumstances time to become separated or detached from the drying fabric or felt 4 more than about 0.05 mm. Furthermore, the over-pressure and flow in the pocket P tend to counteract this separation or detachment. The slight vacuum caused in the cleft G by the flows which are induced in the expanding cleft between the cylinder 2 and the drying fabric 4 also acts in the same direction. If the web W comes off the drying fabric 4 in this part of the arc, air must flow in between them, and this cannot occur in practice, because the web W, even when wet, with a dry matter content less than, or equal to, 65%, has a low permeability and high threshold pressure.

The point of the web W under consideration travels between the cylinders 2 and 1 in the aforedescribed manner, and on arrival at the cylinder 1, the web W is most likely adherent to the drying fabric or felt 4, or, at the most, about 0.1 mm distant therefrom. The web W moves, and/or is urged, against the drying fabric 4, due to the effect of the over-pressure acting in the pocket P on the free draw in question. This also describes a slight curve, thereby causing a centrifugal force additionally urging the web W toward the felt 4. This phenomenon is present on every draw between the cylinders 1 and 2, as well as between the cylinders 2 and 1. As a result, the web W arrives at the cylinder 1, firmly pressed against the drying felt or fabric 4, and passes between said cylinder and said fabric without problems. The aforedescribed phenomena may then be cyclically repeated in the described manner, until the end of the group under discussion.

As hereinbefore mentioned, it is possible, by selection of the position of the roller 3, to actively influence the magnitude of the pressure p in the pocket. In this connection, increasing the arc $\beta_1$, increases both the flow $F_{in}$ and $F_{out}$ and, as a rule, also the difference of these two flows, and thereby the transversal flow $F_t$. When the roller 3 is transposed from the center line toward the dry end, that is, in the direction of travel of the web W, in other words, when the arc $\alpha_1$ is increased, the flows $F_{in}$ and $F_t$ are increased and the pressure p is thereby increased, and the flow $F_{out}$ is decreased.

Figure 2:
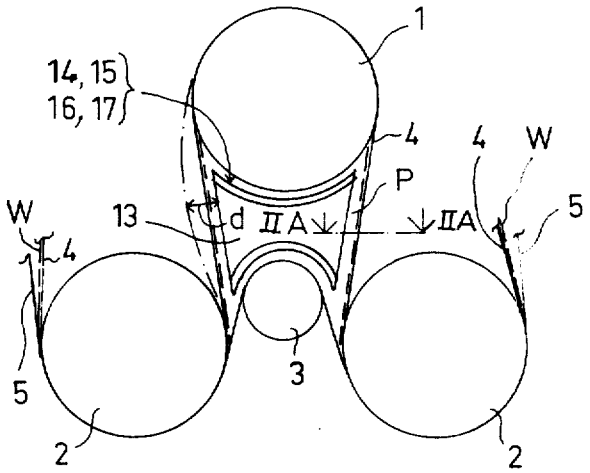
FIG. 2 is a schematic elevational view of another embodiment of the multiple cylinder dryer of the invention, including another embodiment of a pocket pressure increasing device.
Figure 2A:
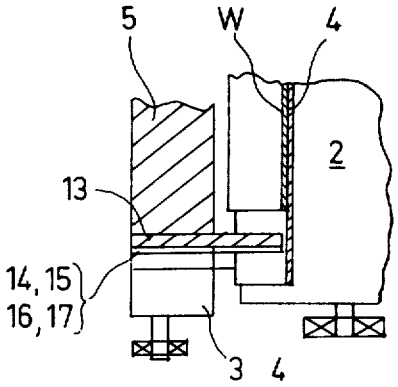
FIG. 2A is a sectional view, on an enlarged scale, taken along the lines IIA—IIA, of FIG. 2.

FIGS. 2 and 2A show another embodiment of the multiple cylinder dryer of the invention. In the embodiment of FIGS. 2 and 2A, the ends of the pocket P are closed in order to prevent the escape of air from the pocket P in the cross-machine direction, or, in other words, in the direction of the transversal flows $F_t$. This results in an increase of the over-pressure p produced in the pocket P, in the manner illustrated in FIG. 1. It is most advantageous to place a flow obstruction 13 on the outside of the web W at a small distance from the cylinder 1, the roller 3 and the drying fabric 4. It is then most advisable to select a drying fabric 4 of which the permeability slightly decreases from a point within the margin of the web W toward its edge. Various types of seals 14, 15, 16 and 17, consisting of plastic, or the equivalent, for example, are provided at the edges of the flow obstruction 13.

The system is stable with regard to the curving of the felt on the free draws from the cylinder 1 to the cylinder 2, because as the pressure increases in the pocket P, the drying fabric or felt 4 and the web W assume a curved shape between said cylinders, as exaggeratedly shown by a dot-and-dash line. The distance d thus increases and the pressure may discharge from the pocket P, so that a state of equilibrium is attained.

Figure 3:
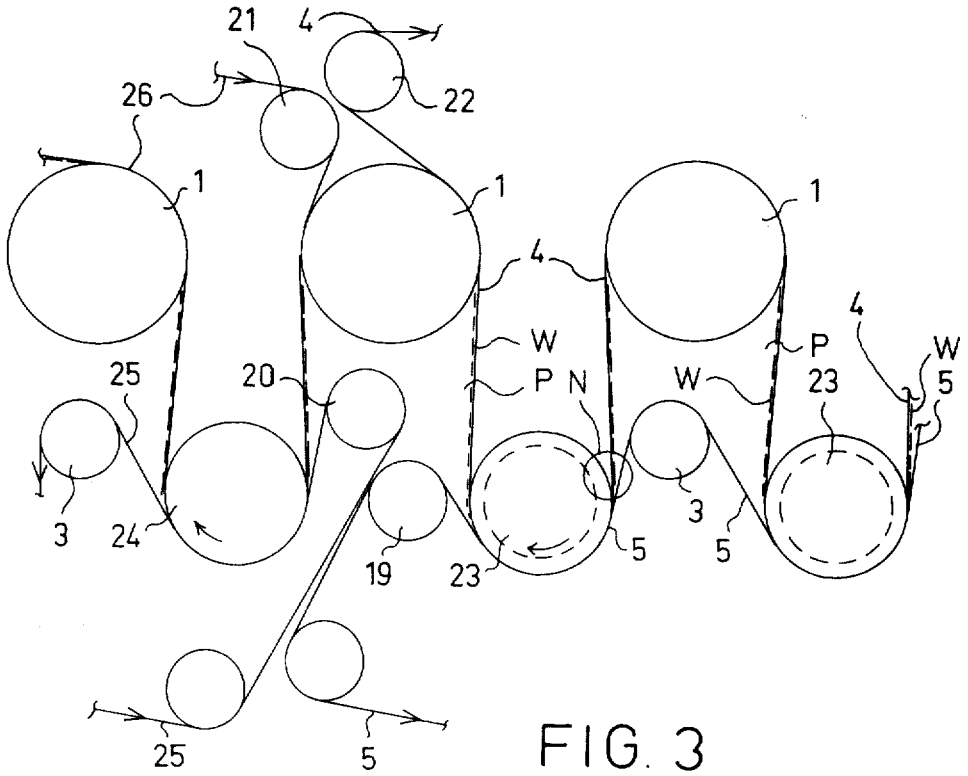
FIG. 3 is a schematic elevational view of a combination embodiment of the multiple cylinder dryer of the invention.

FIG. 3 shows an alternative embodiment of the multiple cylinder dryer of the invention, wherein two groups are interconnected to form a closed conduction system and the upper cylinders 1 have a diameter of different size from that of lower cylinders 23 and 24. In the embodiment of FIG. 3, enough space is set aside at the transfer point for the intercalation of guide rollers 19 and 20, so that, in accordance with the principle of the invention, of the length of the supporting fabric 5 between the cylinder 23 and the roller 19 and the length of supporting fabric 25 on the run between the cylinder 24 and the roller 20 or of the products of said lengths or distances multiplied by the permeability of the respective fabric, the first is larger.

Furthermore, FIG. 3 illustrates the difference in diameter of the cylinders within and without the drying fabric 4 and drying fabric 26. Of these, the cylinders 23 and/or 24 are, for example, common felt guide rollers, that is, unheated. In addition, the cylinders 23 and 24 are favorably grooved, for example, in order to minimize the pressure pulse generated in the closing-down cleft N.

The cylinders internal or external to the fabric 4 and/or 26 may rotate freely, driven by the fabric, whereby the inner loads arising within the groups and the risk of damage are reduced. The drive arrangements are not shown in the Figs. The cylinders 23 and 24 need not be equal in size, but the cylinders 23 and/or 24 contained within each supporting fabric 5 or 25, must be equal in size, since otherwise the felts tend to assume different angular velocities on the cylinders of different radius and cause attrition of the web W.

The procedure of the invention may also be applied to part of one group, to one group or to several groups, up to a point where the paper is dry enough to tolerate the stresses without excessive risk of breaks.

Figure 4:
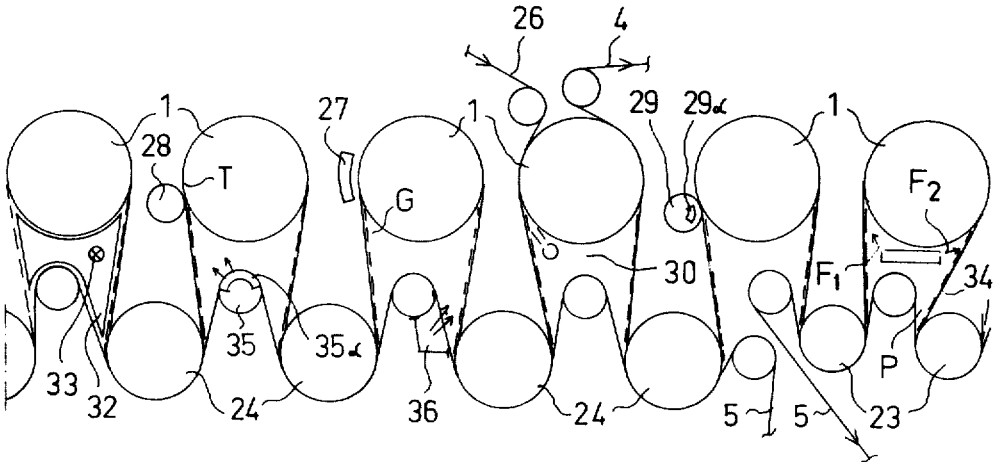
FIG. 4 is a schematic elevational view of different embodiments of the multiple cylinder dryer of the invention, including different devices for influencing the differential pressure.

FIG. 4 illustrates, in addition to a possible arrangement of supporting felts, specific auxiliary means via which it is endeavored to insure that the web W starts to follow along with the drying fabric 4 or 26 at the point where the web W is between said fabrics and the cylinder 1 and where the fabric in question separates from said cylinder. In FIG. 4, a box 27 is connected to an external vacuum source (not shown in the Figs.), or its seals are arranged that the pumping effect on the drying felt or fabric 26 produces a slight sub-atmospheric pressure in said box. The purpose of this sub-atmospheric pressure is to boost and insure the transfer of the web W to travel along with the felt at a tangent point T. The leading edge of the box 27 must then be situated substantially ahead of the tangent point T for the vacuum to have time to act through the felt, and the trailing edge of said box must lie at least at said tangent point, or beyond, in the direction of travel.

A roller 28, shown in FIG. 4, also functions to insure that the web W transfers to travel along with the drying fabric 26. A sub-atmospheric pressure is produced after the roller 28 in the cleft opening up, as known. When the roller 28 is pressed against the tangent point, or pressed in the direction of travel of the web W, slightly after said tangent point, it tends to move said web along with the drying fabric 26. A similar action is also provided by a roller 29, which has a suction zone 29$\alpha$. The rollers 28 and 29 may have metal surfaces or rubber surfaces, for example. The rollers 28 and 29 may be movably, elastically or flexibly mounted such as, for example, via lever arm mechanisms, in order to prevent damage. If the rollers 28 and 29 are movably, elastically or flexibly mounted, a paper cud passing through, for example, cannot damage the apparatus.

It may be insured that the web W follows positively along with the drying fabric 4 at the tangential point T by providing a suitable blowing action $F_1$ at said point. This may be accomplished by a pipe 30, or an equivalent action may also be combined with a box-type beam 34, which may consist of a doctor beam. The pressure p in the pocket P may be increased by other methods, as well. The ends of the pocket P may be restricted with an obstruction 32. Air may be blown into the pocket P utilizing, the compressed air system of the pocket ventilating apparatus, and a blow box 36, or by a separate pipe system 33. Furthermore, the air may be conducted into the pocket P, using a blowing roller 35 as a return roller, and blowing air into said pocket via such route. Air may be directed, or conducted, into the pocket P, to produce air over-pressure in the entire pocket, by the use of the box-type beam 34, from which air is blown in different directions $F_1$ and $F_2$. The aforedescribed procedure and combinations may be combined with the procedures presented.

Figure 5:
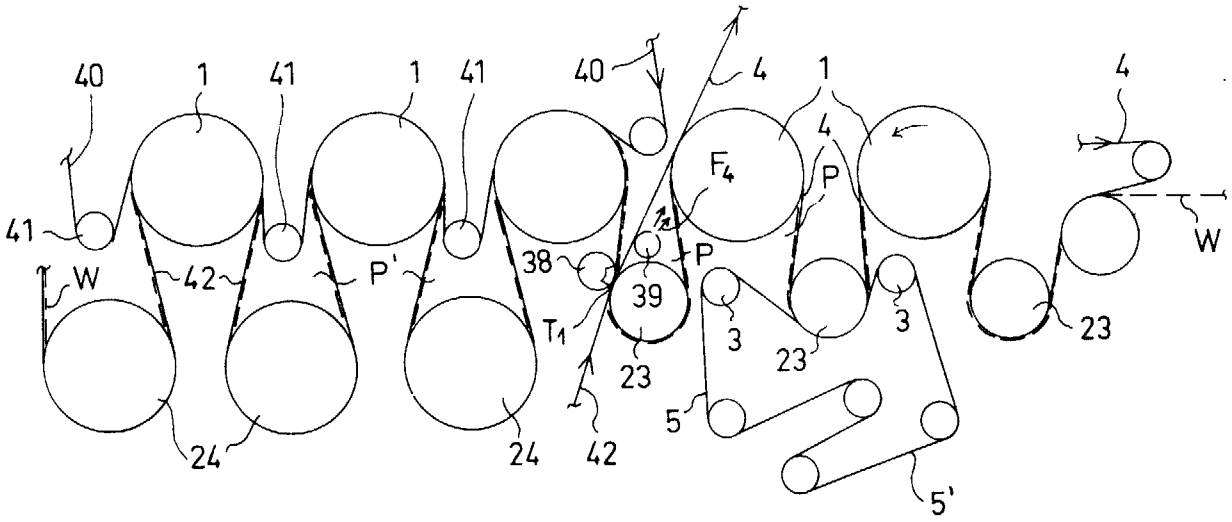
FIG. 5 is a schematic elevational view of still another embodiment of the multiple cylinder dryer of the invention.

FIG. 5 illustrates an embodiment of the multiple cylinder dryer of the invention wherein the running of the principal felt changes from topside position to underside position. The transfer may be assisted by a pressure differential at a transfer point T. The pressure differential may be produced, for example, by a vacuum. A vacuum may be produced by using the suction box 27 (FIG. 4), or a suction roller 38 and/or pressure such as, for example, a blowing action $F_4$ from a separate pipe system 39, or by using the over-pressure box 36, as in FIG. 4. Furthermore, FIG. 5 illustrates the possibility of limited use of the supporting fabric 5 such as, for example, to serve one cylinder. As shown in FIG. 5, the web W transfers from the drying fabric 4 onto a supporting fabric 42 at the transfer point $T_1$. The supporting fabric 42 laps the drying cylinders 1 and 24, supporting the web W. A supporting fabric 40, which supports the web W, is provided on the cylinders 1 and is guided by guide rollers 41 placed in the intervals of said cylinders. The supporting fabric 42 is provided on the outside of the lower cylinders 24, so that the web W is directly against the surfaces of said cylinders. The joint runs of the web W and the supporting fabric 42 between the cylinders 1 and 24, the free surfaces of the lower cylinders 24 and the runs of the supporting fabric 40, guided by the rollers 41, jointly confine within themselves the pockets P' of the aforedescribed type. The pockets P' may, if required, be pressurized in the manner taught by the invention.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a paper machine multiple cylinder dryer having a plurality of drying cylinders, a drying fabric on which a web is adapted to be supported to pass from one cylinder to another in closed conduction, said drying fabric having a cyclic looped run wherein some of said drying cylinders remain within the loop of said supporting fabric and others of said drying cylinders remain outside said loop, a plurality of guide rollers and a supporting fabric guided by said guide rollers and supporting said web on at least some of said cylinders, the runs of said web in said dryer supported by said drying fabric, the free surfaces of said drying cylinders and the runs of said supporting fabric defining in conjunction with said cylinders elongated pockets, and pressure control means for providing an over-pressure higher than the ambient atmospheric pressure in said pockets at least in the initial part of said dryer in the direction of travel of said web, the improvement comprising:

said pressure control means is constituted by means for providing a pumping action by said supporting fabric, and further including web detachment means situated within said drying fabric loop adjacent to an opening throat region defined between a respective cylinder contacted by the web and a portion of the web-carrying drying fabric for creating a slight localized sub-atmospheric pressure acting to urge the web toward said drying fabric as the web is detached from said cylinder to insure detachment of the web from the cylinder and that the web follows along with said drying fabric.

2. A multiple cylinder dryer as claimed in claim 1, wherein said pressure control means further includes closing plates closing both ends of a pocket.

3. A multiple cylinder dryer as claimed in claim 2, wherein said closing plates completely close said ends of said pocket.

4. A multiple cylinder dryer as claimed in claim 2, wherein said closing plates partly close said ends of said pocket.

5. A multiple cylinder dryer as claimed in claim 2, wherein said pressure control means further includes sealing means at the end regions of said pocket for obstructing air flow and raising the level of over-pressure in said pocket.

6. A multiple cylinder dryer as claimed in claim 1, wherein said pressure control means further includes pocket ventilation means disposed within the loop of said supporting fabric for blowing air into said pockets.

7. A multiple cylinder dryer as claimed in claim 1, wherein said pressure control means further includes a return roller inside said supporting fabric at a sector confining a pocket for blowing air through said supporting fabric.

8. A multiple cylinder dryer as claimed in claim 1, wherein said pressure control means further includes a box-type beam in a pocket for blowing air into said pocket.

9. A multiple cylinder dryer as claimed in claim 8, wherein said beam constitutes a doctor beam.

10. A multiple cylinder dryer as claimed in claim 1, further comprising insuring means in the opening-up cleft between said drying fabric and one of said cylinder and said roller external to its loop against which said web lies and outside the loop of said drying fabric and in a pocket for insuring the transfer of said web along with said drying fabric.

11. A multiple cylinder dryer as claimed in claim 8, wherein said insuring means constitutes a blow tube.

12. A multiple cylinder dryer as claimed in claim 10, wherein said insuring means constitutes a box-type beam.

13. A multiple cylinder dryer as claimed in claim 1, wherein said pressure control means are constituted by said guide rollers being displaced so that a free run of said supporting fabric between a respective guide roller and a cylinder immediately prior thereto in the direction of web run is longer than a free run of said supporting fabric between said guide roller and a cylinder immediately subsequent thereto.

14. A multiple cylinder dryer as claimed in claim 1, wherein said web detachment means further includes a static suction box rendered at sub-atmospheric pressure.

15. A multiple cylinder dryer as claimed in claim 14, wherein said suction box extends in the direction of travel of said web from substantially before a tangent point between the web and cylinder constituted by the point of final contact before separation of the web from said cylinder to said tangent point or only slightly beyond.

16. A multiple cylinder dryer as claimed in claim 1, wherein said web detachment means includes a roller positioned substantially at a tangent point between the web and cylinder constituted by the point of final contact before separation of the web from said cylinder.

17. A multiple cylinder dryer as claimed in claim 16, wherein said roller constitutes a suction roller.

* * * * *